US012234567B2

(12) United States Patent
Pandey

(10) Patent No.: US 12,234,567 B2
(45) Date of Patent: Feb. 25, 2025

(54) AIR-PURIFYING, SELF-REGENERATIVE CARBON DIOXIDE CONVERTER BASED ON QUANTUM IMPRINTED NANOMATERIALS

(71) Applicant: L&T TECHNOLOGY SERVICES LIMITED, Chennai (IN)

(72) Inventor: Indu Pandey, Bhadohi (IN)

(73) Assignee: L&T TECHNOLOGY SERVICES LIMITED, Chennai (IN)

( * ) Notice: Subject to any disclaimer, the term of this patent is extended or adjusted under 35 U.S.C. 154(b) by 0 days.

(21) Appl. No.: 18/169,751

(22) Filed: Feb. 15, 2023

(65) Prior Publication Data

US 2024/0044020 A1 Feb. 8, 2024

(30) Foreign Application Priority Data

Aug. 1, 2022 (IN) ..... 202241043842

(51) Int. Cl.

| | |
|---|---|
| ***C25B 3/07*** | (2021.01) |
| ***C25B 3/26*** | (2021.01) |
| ***C25B 5/00*** | (2006.01) |
| ***C25B 9/19*** | (2021.01) |
| ***C25B 11/067*** | (2021.01) |
| ***C25B 11/085*** | (2021.01) |
| ***C25B 13/05*** | (2021.01) |
| ***C25B 15/08*** | (2006.01) |

(52) U.S. Cl.

CPC ..... *C25B 3/26* (2021.01); *C25B 3/07* (2021.01); *C25B 5/00* (2013.01); *C25B 9/19* (2021.01); *C25B 11/067* (2021.01); *C25B 11/085* (2021.01); *C25B 13/05* (2021.01); *C25B 15/08* (2013.01)

(58) Field of Classification Search

CPC ..... C25B 3/07; C25B 3/26
USPC ..... 205/450
See application file for complete search history.

(56) References Cited

FOREIGN PATENT DOCUMENTS

| | | | | |
|---|---|---|---|---|
| CN | 103035842 A * | 4/2013 | ..... | H01L 51/05 |
| WO | WO-2010037109 A2 * | 4/2010 | ..... | B01D 53/1475 |

OTHER PUBLICATIONS

O'Mara et al., "Cascade Reactions in Nanozymes: Spatially Separated Active Sites Inside Ag-Core-Porous-Cu-Shell Nanoparticles for Multistep Carbon Dioxide Reduction to Higher Organic Molecules," Journal of the American Chemical Society (Aug. 25, 2019), vol. 141, No. 36, pp. 14093-14097. (Year: 2019).*

Shin et al., "Functionalized Carbon Dots on Graphene as Outstanding Non-Metal Bifunctional Oxygen Electrocatalyst," Small (Apr. 2019), vol. 15, No. 16, pp. 1-9. (Year: 2019).*

* cited by examiner

*Primary Examiner* — Edna Wong
(74) *Attorney, Agent, or Firm* — Kendal M. Sheets

(57) ABSTRACT

The present disclosure generally relates to the field of chemical sciences and negative emission technology. The disclosure further relates to a process for converting carbon dioxide into methanol by employing quantum imprinted nanomaterials (containing nanozymes) via electrochemical reduction. The disclosure furthermore relates to an electrochemical cell which has the capability of converting carbon dioxide to methanol, wherein the electrochemical cell comprises an anode comprising Zn quantum material and a cathode comprising nano quartz coated with nanozyme(s) incorporated printed polymer with selective 3D imprinted memory for carbon dioxide electrochemical reduction.

8 Claims, 4 Drawing Sheets

AIR-PURIFYING, SELF-REGENERATIVE CARBON DIOXIDE CONVERTER BASED ON QUANTUM IMPRINTED NANOMATERIALS

CROSS-REFERENCE TO RELATED APPLICATIONS

The present application claims priority to India Application No. 202241043842 filed with the Intellectual Property Office of India on Aug. 1, 2022 and entitled "AIR-PURIFYING, SELF-REGENERATIVE CARBON DIOXIDE CONVERTER BASED ON QUANTUM IMPRINTED NANOMATERIALS," which is incorporated herein by reference in their entirety for all purposes.

TECHNICAL FIELD

The present disclosure generally relates to the field of chemical sciences and negative emission technology. The disclosure further relates to a process for converting carbon dioxide into methanol by employing quantum imprinted nanomaterials (containing nanozymes) via electrochemical reduction. The disclosure furthermore relates to an electrochemical cell (1) which has the capability of converting carbon dioxide to methanol, wherein the electrochemical cell comprises an anode (5) comprising Zn quantum material and a cathode (6) comprising nano quartz coated with nanozyme(s) incorporated printed polymer with selective 3D imprinted memory for carbon dioxide electrochemical reduction.

BACKGROUND

Carbon dioxide ($CO_2$) is a potential greenhouse gas, although its conversion to alternative fuels represents a promising approach to limit its long-term effects. With the development of human society, the decrease in fossil energy and the increase in $CO_2$ concentration have aroused great attention. For instance, the energy crisis, greenhouse effect, and ocean acidification are some of the main problems facing humanity. Converting $CO_2$ into green fuels is considered as one of the ideal solutions, which can solve not only the environmental problems but also the high requirements of energy consumption. Various methods have been explored to convert $CO_2$ to organic fuels, such as photocatalytic reduction, electro-catalytic reduction, biological transformation, hydrogenation, and dry reforming. Nevertheless, hydrogenation of $CO_2$ to the form $CH_3OH$ process requires high operating temperatures (200-250° C.) and high pressures (5-10 MPa), which limit the yield of methanol. As a matter of fact, capturing carbon dioxide reduction of $CO_2$ can be carried out at mild temperature and pressure, but it does not work in dark. It would be meaningful to harvest carbon dioxide as a precursor of green fuel without dependency on the sun, wind power, and large scaled step process. Such a motive is reasonable because piezoelectric materials can convert mechanical energy into electric energy via a change in pressure/change in the straining process. The present disclosure aims to address the above limitations of the prior art and provides an efficient and robust method for the conversion of carbon dioxide into methanol.

SUMMARY OF THE DISCLOSURE

The present disclosure provides a process for the conversion of carbon dioxide to methanol, wherein the said process comprises steps of:

a) capturing/feeding carbon dioxide from a natural source or a chemical source;

b) treating the captured carbon dioxide with a self-folding property film present on an outer ceramic layer in presence of moisture, wherein said film comprises carbon derived from bamboo, alginate, and nanocellulose to obtain carbonic acid;

c) filtering the carbonic acid by a membrane filter to obtain filtered carbonic acid in an inner electrochemical cell;

d) hydrolyzing the filtered carbonic acid to obtain carbon dioxide and water;

e) reducing the obtained carbon dioxide in presence of printed polymer with selective 3D memory to obtain methanol, wherein a reduction is carried out in an electrochemical cell containing an anode comprising Zn quantum material; a cathode comprising nano quartz coated with nanozyme(s) incorporated printed polymer with selective 3D imprinted memory for carbon dioxide, and an electrolyte containing ethylene glycol, and sodium hydroxide; and an electrochemical cell (1) which has the capability of converting carbon dioxide to methanol comprising:

i. an outer ceramic layer (2) coated with the carbon of foldable bamboo wood integrated with alginate/nanocellulose film;

ii. a membrane filter (3) comprising of 0.5-1 μm pore diameter size, with $CO_2$ permeability (0.0035 L/m2/h) with improved antifouling properties;

iii. an electrochemical inner cell (4)

A. an anode (5) comprising Zn quantum material,

B. a cathode (6) comprising nano quartz coated with nanozyme(s) incorporated printed polymer with selective 3D imprinted memory for carbon dioxide, C. an electrolyte (7) comprising ethylene glycol, and sodium hydroxide, D. an electrical connection between said anode and said cathode, wherein the electrochemical cell comprises an inlet (8) from the outside layer to the inner cell to transfer the contents from the outside layer to the inner cell.

BRIEF DESCRIPTION OF FIGURES

In order that the disclosure may be readily understood and put into practical effect, reference will now be made to exemplary embodiments as illustrated with reference to the accompanying figures. The figures together with a detailed description below form a part of the specification, and serve to further illustrate the embodiments and explain various principles and advantages, in accordance with the present disclosure wherein.

DETAILED DESCRIPTION OF THE DISCLOSURE

Figure 1:
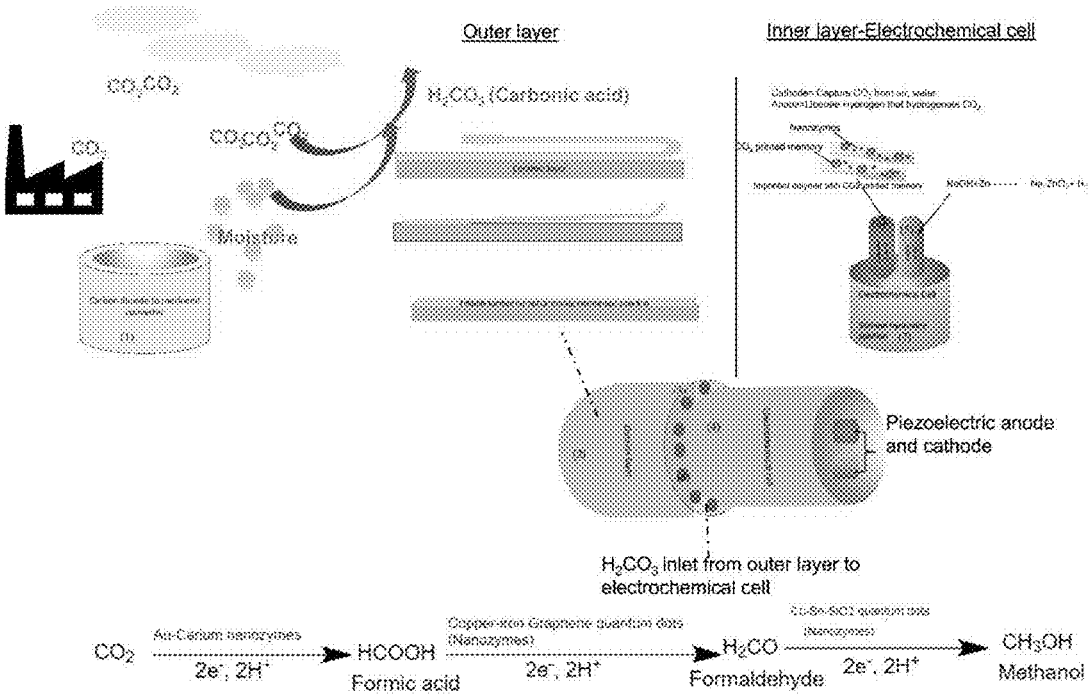
FIG. 1 depicts a block diagram of an electrochemical cell (1)

The foregoing has broadly outlined the features and technical advantages of the present disclosure in order that the detailed description of the disclosure that follows may be better understood. Additional features and advantages of the disclosure will be described hereinafter which form the subject of the description of the disclosure. It should also be realized by those skilled in the art that such equivalent products and methods do not depart from the scope of the disclosure. The novel features which are believed to be characteristic of the disclosure, as to a method of operation, together with further objects and advantages will be better understood from the following description when considered in connection with the accompanying figures. It is to be expressly understood, however, that the figure provided here is for the purpose of illustration and description only and is not intended as a definition of the limits of the present disclosure. Further, for the purposes of the following detailed description, it is to be understood that the invention may assume various alternative variations and step sequences, except where expressly specified to the contrary.

Thus, before describing the present invention in detail, it is to be understood that this invention is not limited to particularly exemplified products and process parameters or methods that may, of course, vary. It is also to be understood that the terminology used herein is for the purpose of describing particular embodiments of the invention only and is not intended to limit the scope of the invention in any manner.

While the disclosure is susceptible to various modifications and alternative forms, specific embodiment thereof has been shown by way of example(s) and will be described in detail below. It should be understood, however, that it is not intended to limit the disclosure to particular forms disclosed, but on the contrary, the disclosure is to cover all modifications, equivalents, and alternatives, falling within the spirit and the scope of the disclosure. Thus, the use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In case of conflict, the present document, including definitions will control.

It must be noted that, as used in this specification and the appended claims, the singular forms "a," "an" and "the" include plural referents unless the content clearly dictates otherwise. Thus, for example, reference to a "solvent" may include two or more such solvents.

The terms "preferred" and "preferable" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

As used herein, the terms "comprising", "including", "containing", "involving," and the like are to be understood to be open-ended, i.e., to mean including but not limited to. Further, the terms "comprises", "comprising", or any other variations thereof, are intended to cover a non-exclusive inclusion, such that a method that comprises a list of acts does not include only those acts but may include other acts not expressly listed or inherent to such method. In other words, one or more acts in a method proceeded by "comprises . . . a" does not, without more constraints, preclude the existence of other acts or additional acts.

In general, the terms electrochemical cell, device, converter, system, and/or similar words used herein interchangeably refer to the equipment/apparatus useful for converting carbon dioxide into methanol.

With respect to the use of substantially any plural and/or singular terms herein, those having skill in the art can translate from the plural to the singular and/or from the singular to the plural as is appropriate to the context and/or application. Various singular/plural permutations may be expressly set forth herein for sake of clarity.

Any discussion of documents, methods, acts, materials, devices, articles, and the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

A detailed description for the purpose of illustrating representative embodiments of the present invention is given below, but these embodiments should not be construed as limiting the present invention.

Embodiments of the present invention relate to the simple, efficient, and economical conversion of carbon dioxide to reduced organic products, such as methanol, formic acid and formaldehyde.

The present disclosure relates to a process for the conversion of carbon dioxide to methanol, wherein the said process comprises steps of:

a) capturing/feeding carbon dioxide from a natural source or a chemical source;
b) treating the captured carbon dioxide with a self-folding property film present on an outer ceramic layer in presence of moisture, wherein said film comprises carbon derived from bamboo, alginate, and nanocellulose to obtain carbonic acid;
c) filtering the carbonic acid by a membrane filter to obtain filtered carbonic acid in an inner electrochemical cell;
d) hydrolysing the filtered carbonic acid to obtain carbon dioxide and water;
e) reducing the obtained carbon dioxide in presence of printed polymer with selective 3D memory to obtain methanol,
   wherein a reduction is carried out in an electrochemical cell containing an anode comprising Zn quantum material; a cathode comprising nano quartz coated with nanozyme(s) incorporated printed polymer with selective 3D imprinted memory for carbon dioxide, and an electrolyte containing ethylene glycol, and sodium hydroxide.

In an embodiment of the present disclosure, the nanozyme(s) are Au-cerium nanozyme, copper-iron Graphene quantum dots, and Co—Sn—$SiO_2$ Graphene quantum dots and combinations thereof.

In an embodiment of the present disclosure, the electrochemical/photoelectrochemical reduction of $CO_2$ utilizes nanozyme(s).

In another embodiment of the present disclosure, the electrochemical/photoelectrochemical reduction of $CO_2$ utilizes Au-cerium nanozyme, copper-iron Graphene quantum dots, and Co—Sn—$SiO_2$ Graphene quantum dots and combinations thereof.

In another embodiment of the present disclosure, the sodium hydroxide reacts with zinc quantum material to produce hydrogen.

In an embodiment of the present disclosure, the step (e) further comprises the steps of f) subjecting the carbon dioxide obtained from step (e) to a reduction in presence of Au-cerium nanozyme and hydrogen to obtain formic acid;

g) subjecting the formic acid obtained from step (f) to a reduction in presence of copper-iron Graphene quantum dots nanozyme and hydrogen to obtain formaldehyde; and h) subjecting the formaldehyde obtained from step (g) to a reduction in presence of Co—Sn—$SiO_2$ Graphene quantum dots nanozyme and hydrogen to obtain methanol.

In an embodiment of the present disclosure, the natural source for obtaining carbon dioxide includes natural gas or oil deposits, subterranean pockets or pore spaces (rich in carbon dioxide), water, ocean, atmosphere, breath air; and wherein the chemical source includes combustion, fermentation, or the manufacture of cement or steel.

An example of an overall reaction for the reduction of carbon dioxide may be represented as follows:

Scheme 1 Reduction of carbon dioxide to methanol

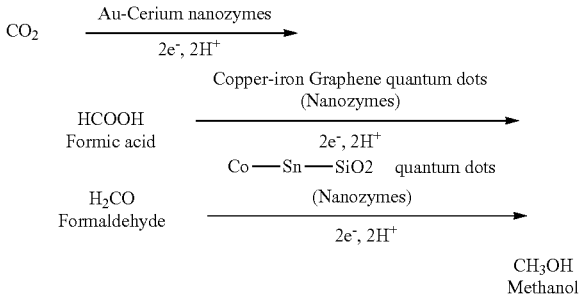

In another embodiment of the present disclosure, the process is carried out at a temperature ranging from about 50° C. to about 150° C., and for a time period ranging from about 60 minutes to about 10 hours.

In an embodiment of the present disclosure, the step h) further comprises isolation and/or purification of the corresponding product; wherein said isolation is carried out by acts selected from a group comprising the addition of solvent, the addition of ionic resin, quenching, distillation filtration, extraction and combination of acts thereof.

The present disclosure relates an electrochemical cell (1) that has the capability of converting carbon dioxide to methanol comprising:

i. an outer ceramic layer (2) coated with the carbon of foldable bamboo wood integrated with alginate/nanocellulose film;

ii. a membrane filter (3) comprising of 0.5-1 μm pore diameter size, with $CO_2$ permeability (0.0035 L/m2/h) with improved antifouling properties;

iii. an electrochemical inner cell (4)

A. an anode (5) comprising Zn quantum material,

B. a cathode (6) comprising nano quartz coated with nanozyme(s) incorporated printed polymer with selective c imprinted memory for carbon dioxide, C. an electrolyte (7) comprising ethylene glycol, and sodium hydroxide, D. an electrical connection between said anode and said cathode, wherein the electrochemical cell comprises an inlet (8) from the outside layer to the inner cell to transfer the contents from the outside layer to the inner cell.

In an embodiment of the present disclosure, the nanozyme (s) are Au-cerium nanozyme, copper-iron Graphene quantum dots, and Co—Sn—$SiO_2$ Graphene quantum dots and combinations thereof; wherein the electrode materials are piezoelectric, which generate electricity with change in mass results and stress due to carbon dioxide adsorption and desorption; wherein the inlet channelizes the passage of carbonic acids into the inner electrochemical cells via hot-pressing film.

The electrochemical cell or device is made up of foldable bamboo wood integrated alginate/nanocellulose coated ceramic-based converter which captures direct carbon dioxide from the atmosphere. Once outer coated foldable bamboo wood is integrated alginate/nanocellulose film highly saturated reacts with moisture and converts into carbonic acids. These carbonic acids pass to the inner electrochemical cells via hot-pressing film.

Inner cell assembly contains electrolytes, wherein said electrolytes are sodium hydroxide and ethylene glycol. In $CO_2$ is directly inserted into the electrolyte and remains in solvent as carbonates.

Artificial enzymes were synthesized by using serine and threonine composite carbon dioxide memory containing polymers which are doped with gold nanoparticles, copper nanozymes, and calcium-doped graphene nanoparticles to act as an artificial enzymatic layer. Whole system work as a converter that adsorbs carbon dioxide and converts it into methanol with 100% efficiency.

In another embodiment of the present disclosure, the aforesaid process is carried out employing the electrochemical cell (1) for converting carbon dioxide into methanol via hydrogenation in presence of hydrogen gas.

The present disclosure is further defined in the following examples. It should be understood that these examples indicating exemplary embodiments of the present disclosure are given by way of illustration only and should not be construed to limit the scope of the disclosure. From the above discussion and these examples, one skilled in the art can ascertain the essential characteristics of this disclosure, and without departing from the spirit and scope thereof, can make various changes and modifications of the disclosure to adapt it to various uses and conditions.

EXAMPLES

Example 1

Development of Piezoelectric anode: The fabrication of an anode consists of 3 steps:

1. Synthesis of Au-Ceria nanozymes: 0.5 mM of Au and 0.5 mM Cerium nitrate were dissolved in 8 mL of 0.25 mM L-tryptophan and polyionic liquids. Total volume made up to 10 mL by adding ammonia. The solution was ultrasonicated and kept at 100° C. for 3 hrs. The resultant Au/CeO2 CSNPs were centrifuged at 10,000 g for 20 min. The precipitate was re-dispersed into 1 mL water for further use.

2. Synthesis of Graphene oxide quantum dots with Copper-iron nanozymes: Graphene (0.5 mg), was used to prepare Graphene oxide quantum dots with Copper-iron nanozymes using a simple method. First, 50 mM CuSO4, 50 mM FeSO4 and 1 mg/mL tryptophan solution in deionized water were prepared. Then, 100 μL of tryptophan solution was added to 20 mL of tris buffer solution (2.5 mM, pH 6.5) containing 100 μL of CuSO4-$FeSO_4$ solution. The solution was gently shaken for about 30 min, and then, the mixture was incubated at 30° C. for 20 h. The reaction solution was centrifuged at 12,000 rpm for 30 min to obtain the precipitates. The collected brown precipitates were washed and dried at 30° C.
3. Cobalt-Sn—$SiO_2$ nanozymes: Typically, an amount of cobalt chloride and Sn $Cl_2$ (1.07 g) was mixed with Silica (10 mg). Then the mixture was dissolved directly in ethylene glycol (150 mL), After the mixture had been stirred for 30 minutes, ammonia (1.5 mg) was then added to the above solution. The mixture was kept vigorously stirring at T=90° C. for 30 min. Subsequently, a 10 mg mL NaBH4 aqueous solution was added dropwise to trigger the reaction. After 2-3 hr stirring of the mixture, finally, the product was washed with ethanol. The reaction solution was centrifuged at 10,000 rpm for 15 min to obtain the precipitates. The collected brown precipitates were washed and dried at 35° C.
4. Formation 3D imprinted $CO_2$ selective polymers: The threonine-serine polymer (0.05 M, each) with PBS and carbonic acid (pH 6.4, 100 mL) was electrochemically grown on mercaptan (0.5% loading)-quartz at −1.8V to 1.2 V at 100 mV/s at room temperature for 45 cycles for 2 hrs. All three nanozymes were added (1 mL, each) in an electrolyte containing threonine-serine polymer with PBS (pH 6.4, 100 mL) to get embedded nanozymes. The $CO_2$ specific cavity was prepared by washing polymer with 100-200 mL of ethanol and NaOH (1:1) solution followed by water washing. The resulted piezoelectric anode was developed with $CO_2$ 3D printed memory.
5. Electrochemical conversion of $CO_2$ to methanol was performed by using an electrochemical technique: differential pulse voltammetry at a temperature ranging from about 40° C.-80° C., preferably at a temperature ranging from about 60° C. to 70° C., pH=5.5, pressure=30 atm.

Electrochemical System:

The electrochemical system was composed of anode 5 and cathode 6. C. An electrolyte (7) comprising ethylene glycol, and sodium hydroxide were employed to carry out the aforementioned process. The electrolytes 7 were used at concentrations of 0.5 M to 1.0 M, with 1M being a typical concentration. A concentration of between about 0.03 mM to 0.25 M of the nanozyme was used. The particular nanozyme of each given reaction was generally selected based upon what product or products were being created.

Referring to FIG. 1, a flow diagram of an example method used in the electrochemical examples is shown. The Electrochemical system method is implemented using system 1.

In step 1, electrodes 5 and 6 may be activated where appropriate. Carbon dioxide is adsorbed and treated with a self-folding property film present on an outer ceramic layer in presence of moisture, wherein said film comprises carbon derived from bamboo, alginate, and nanocellulose to obtain carbonic acid. Foldable bamboo wood integrated alginate/nanocelluose coated ceramic surface can capture carbon dioxide due to bamboo as a sinker and alginate/cellulose can adsorb it effectively. With high adsorption of $CO_2$ starts folding up and with $CO_2$ loading, high folding of the film is squeezed to generate carbonic acid. Carbonic acid is filtered by a membrane filter to obtain filtered carbonic acid and was passed into an inner electrochemical cell. The filtered carbonic acid splits into carbon dioxide and water in the electrochemical step. Further, carbon dioxide is captured quantitatively via the adsorption process from the air as well as carbonic acid. The adsorbed carbon dioxide is reduced in presence of printed polymer with selective 3D printed memory to obtain methanol in the presence of Au-cerium nanozyme, copper-iron Graphene quantum dots, and Co—Sn—$SiO_2$ Graphene quantum dots.

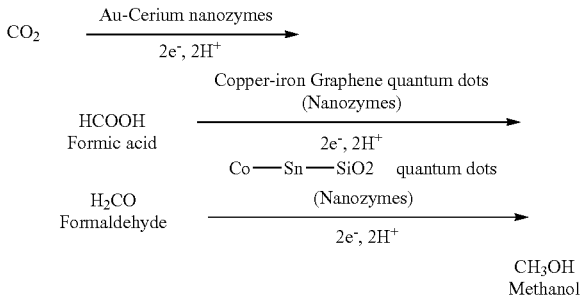

An anode generates hydrogen via reacting with sodium hydroxide. Cathode selectively adsorbs carbon dioxide from the air as well as solution. Electrode materials are piezoelectric, which generates electricity with a change in mass resulting in a change in stress due to $CO_2$ adsorption and desorption. Methanol is separated from the water via a distillation process and is quantified.

Figure 2:
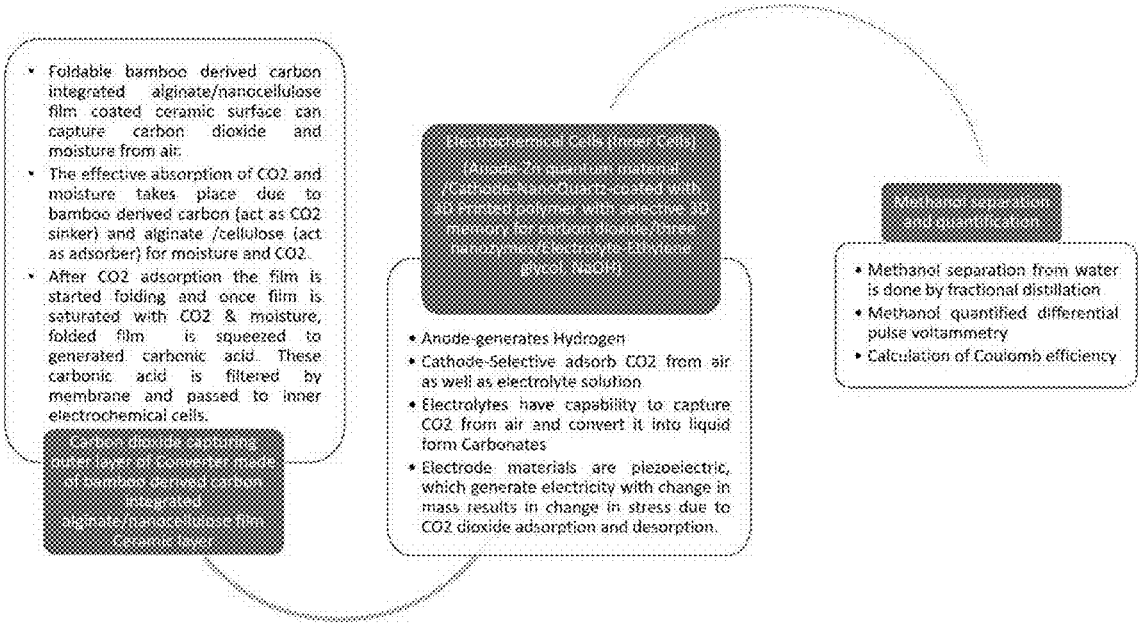
FIG. 2 depicts along with a flow diagram of an example method used in electrochemical examples for converting carbon dioxide into methanol.

Results: FIG. 2 shows the $CO_2$ adsorption isotherms of 3D printed polymer modified Converter and Non printed polymer (no 3D printed cavities/reference polymers) modified converter at 273K. The imprinted sample, owing to the presence of amide and hydroxyl groups-decorated imprinted cavities, had considerably larger $CO_2$ capture capacities over the entire range of $CO_2$ partial pressures and at both measured temperatures compared to the non-printed polymer modified converter.

Figure 3:
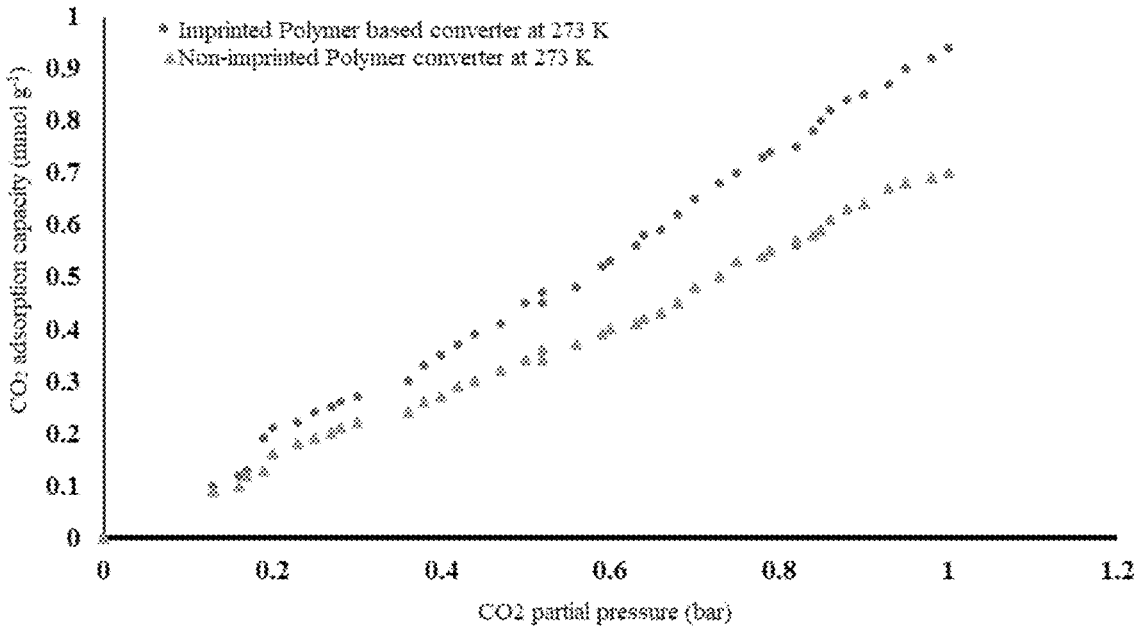
FIG. 3 depicts a comparison of $CO_2$ adsorption isotherms at 273 K.
Figure 4:
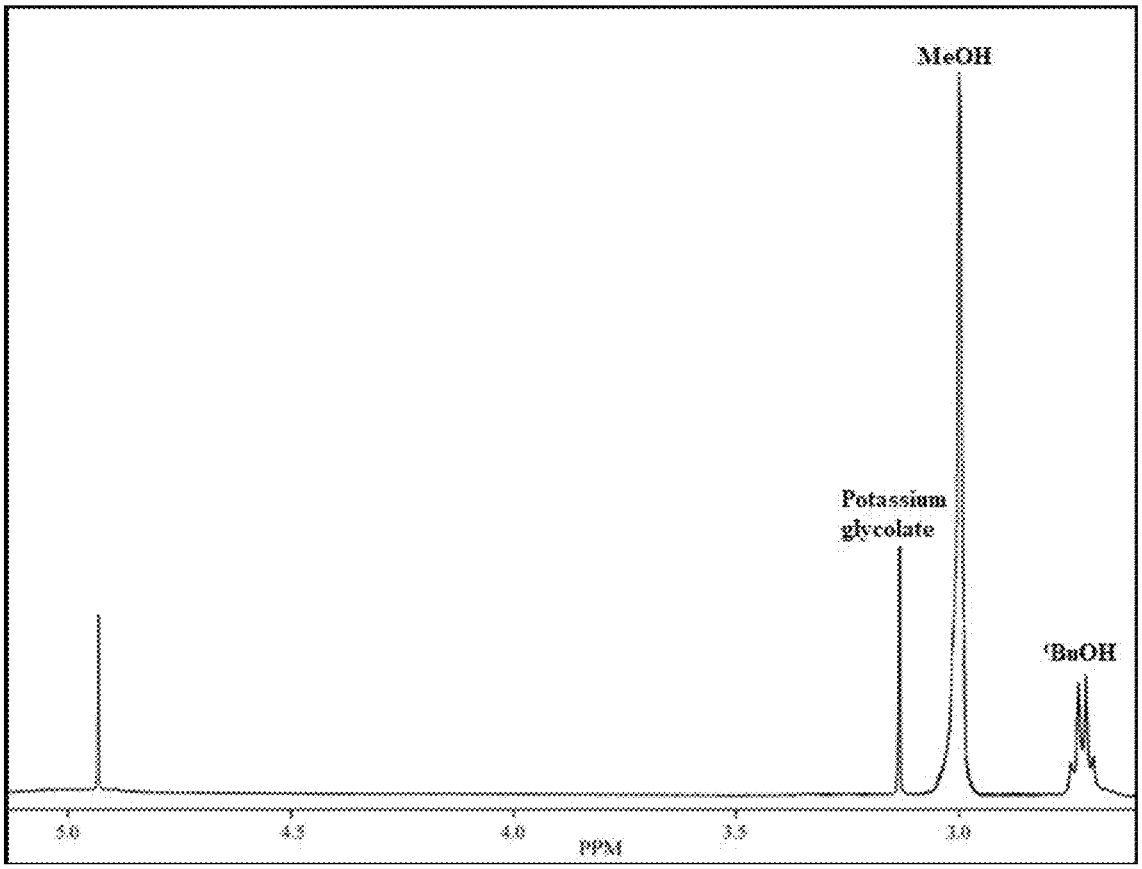
FIG. 4 depicts the NMR spectra of the reaction mixture after the hydrogenation reaction of captured $CO_2$ (Table 1) in DMSO-d6.

FIG. 3 shows the $CO_2$ adsorption isotherms of 3D printed polymers and NIPs at 273 K. The nonimprinted polymer (NIP) particles have been synthesized using the same procedure, except that no template was used. This polymer is a reference polymer with the same composition with no 3D printed memory for carbon dioxide. The 3D printed polymers, owing to the presence of amide and hydroxyl groups decorated carbon dioxide 3D printed cavities, have considerably larger $CO_2$ capture capacities over the entire range of $CO_2$ partial pressures and at both measured temperatures. This comparative study revealed the selectivity and adsorption efficiency of developed 3D printed polymers. It also confirms the creation of stable 3D printed cavities and integral part of polymer which is used to modify cathode.

Electrochemical reaction condition: Reaction conditions: 70° C. b Yields determined by Differential Pulse Voltammetry (Voltage range −1.0V to 1.5 V) at 0.01 M Tris buffer (pH=5.5) at 0.05 $mVs^{-1}$ (scan rate), stirring 8000 rpm. Yield calculations error ±3%.

TABLE 1

Direct air capture of CO2 and conversion into methanol

| $CO_2$ capture outer layer[a] | $CO_2$ capture inner layer | Time | Temperature | Methanol % |
|---|---|---|---|---|
| 5 mmol | 10 mmol | 1 h | 70° C. | 92 |
| 10 mmol | 25 mmol | 3 h | 70° C. | 94 |
| 20 mmol | 50 mmol | 5 h | 70° C. | 96 |
| 50 mmol | 80 mmol | 10 h | 70° C. | 100 |

[a]=capture efficiency determined by gravimetric analysis.

Thus, the efficacy of the system was tested for direct air capture of $CO_2$ and conversion to $CH_3OH$ (methanol) (Table 1). After 10 h, 50 mmol of $CO_2$ (outer layer) and 80 mmol captured (inner layer) were captured in the form of carbonic acid and carbonate salts. When the resulting solution was hydrogenated, $CH_3OH$ was obtained with a 96% yield after 5 h. When the reaction was extended to 10 h, the captured $CO_2$ was completely converted to $CH_3OH$ (100%).

Example 2

NMR Analysis

The capture of $CO_2$ was performed in the same electrochemical cell and was used subsequently for hydrogenation reactions. Upon completion of $CO_2$ capturing, N2 purging was done, $H_2$ gas was supplied to the desired pressure (generally 70 bar). The reaction mixture was then stirred with a magnetic stirrer for 25 minutes (800 rpm-1000 rpm). After heating for a given period of time, the reactor was cooled to room temperature. The vessel was then cooled for 60 minutes at room temperature and the gases inside were slowly released. Upon opening the reaction vessel, a known amount of tBuOH was added as an internal standard to the homogeneous solution which was then analyzed by 1H with DMSO-d6 as the deuterated solvent. Yields were determined through 1H NMR from integration ratios.

We claim:

1. A process for the conversion of carbon dioxide to methanol, wherein the said process comprises steps of:

a) capturing/feeding carbon dioxide from a natural source or a chemical source;

b) treating the captured carbon dioxide with a self-folding property film present on an outer ceramic layer in presence of moisture, wherein said film comprises carbon derived from bamboo, alginate, and nanocellulose to obtain carbonic acid;

c) filtering the carbonic acid by a membrane filter to obtain filtered carbonic acid in an inner electrochemical cell;

d) hydrolysing the filtered carbonic acid to obtain carbon dioxide and water;

e) reducing, via electrochemical reduction, the obtained carbon dioxide in presence of an imprinted polymer with a selective 3D imprinted memory to obtain methanol, wherein the reduction is carried out in the inner electrochemical cell containing an anode comprising zinc (Zn) quantum material; a cathode comprising nano quartz coated with nanozyme(s) incorporated the imprinted polymer with the selective 3D imprinted memory for the obtained carbon dioxide, and an electrolyte containing ethylene glycol and sodium hydroxide.

2. The process as claimed in claim 1, wherein the nanozyme(s) are Au-cerium nanozyme, copper-iron graphene quantum dots, and Co—Sn—$SiO_2$ graphene quantum dots.

3. The process as claimed in claim 1, wherein the sodium hydroxide reacts with the zinc quantum material to produce hydrogen.

4. The process as claimed in claim 3, wherein step (e) further comprises the steps of:

f) subjecting the obtained carbon dioxide obtained from step (d) to the electrochemical reduction in presence of the Au-cerium nanozyme and the hydrogen to obtain formic acid;

g) subjecting the formic acid obtained from step (f) to a reduction in presence of copper-iron graphene quantum dots nanozyme and the hydrogen to obtain formaldehyde; and h) subjecting the formaldehyde obtained from step (g) to the electrochemical reduction in presence of the Co—Sn—$SiO_2$ graphene quantum dots and the hydrogen to obtain the methanol.

5. The process as claimed in claim 4, wherein the process further comprises a step of isolation and/or purification of a corresponding product; wherein said isolation is carried out by acts selected from the group consisting of the addition of a solvent, the addition of an ionic resin, quenching, distillation filtration, extraction and combination of the acts thereof.

6. The process as claimed in claim 1, wherein the natural source for capturing the carbon dioxide includes:

natural gas, subterranean pockets, water, ocean, atmosphere, and breath air; and wherein the chemical source includes combustion, fermentation, or manufacture of cement or steel.

7. The process as claimed in claim 1, wherein said process is carried out at a temperature ranging from about 50° C. to about 150° C., and for a time period ranging from about 60 minutes to about 10 hours.

8. The process as claimed in claim 1, wherein the reduction is carried out employing the inner electrochemical cell for converting the carbon dioxide into the methanol via hydrogenation in presence of hydrogen gas.

* * * * *